US010580374B2

(12) United States Patent
Wu et al.

(10) Patent No.: US 10,580,374 B2
(45) Date of Patent: Mar. 3, 2020

(54) CO-GATE ELECTRODE BETWEEN PIXELS STRUCTURE

(71) Applicant: GIANTPLUS TECHNOLOGY CO., LTD., Toufen (TW)

(72) Inventors: Che-Yao Wu, Taoyuan (TW); Kai-Ju Chou, Taoyuan (TW); I-Ta Jiang, New Taipei (TW)

(73) Assignee: Giantplus Technology Co., Ltd., Toufen, Miaoli County (TW)

( * ) Notice: Subject to any disclaimer, the term of this patent is extended or adjusted under 35 U.S.C. 154(b) by 74 days.

(21) Appl. No.: 15/972,495

(22) Filed: May 7, 2018

(65) Prior Publication Data

US 2019/0228727 A1 Jul. 25, 2019

(30) Foreign Application Priority Data

Jan. 24, 2018 (TW) ..... 107201169 U

(51) Int. Cl.
*G09G 3/36* (2006.01)

(52) U.S. Cl.
CPC ... *G09G 3/3659* (2013.01); *G09G 2300/0456* (2013.01); *G09G 2300/0842* (2013.01); *G09G 2300/0876* (2013.01); *G09G 2310/0251* (2013.01); *G09G 2330/021* (2013.01)

(58) Field of Classification Search
CPC ..... G09G 2300/0876; G09G 3/3659; G09G 2310/0251
See application file for complete search history.

(56) References Cited

U.S. PATENT DOCUMENTS 6,011,530 A 1/2000 Kawahata et al.
2002/0075219 A1* 6/2002 Morita ..... G09G 3/3648 345/92
2007/0262936 A1* 11/2007 Chang ..... B29C 59/026 345/87
2009/0141221 A1* 6/2009 Taguchi ..... G02F 1/133512 349/109
2010/0085520 A1* 4/2010 Katayama ..... G02F 1/133753 349/114
2014/0146027 A1* 5/2014 Tsuge ..... G09G 3/3233 345/208
2016/0078599 A1* 3/2016 Furihata ..... G06T 3/403 345/667

* cited by examiner

*Primary Examiner* — Abbas I Abdulselam
(74) *Attorney, Agent, or Firm* — Rosenberg, Klein & Lee

(57) ABSTRACT

A co-gate electrode between pixels structure includes a first pixel and a second pixel. The first pixel has a first control switch is electrically connected to a main control switch. The main control switch selectively receives an external voltage and then transmits the external voltage to the first control switch. The first control switch selectively receives the external voltage, lest the external voltage transmitted to the first pixel to charge or discharge establish a voltage drop. The second pixel has a second control switch, which is electrically connected to the main control switch to selectively receive the external voltage transmitted by the main control switch, lest the external voltage that is transmitted to the second pixel to charge or discharge establish a voltage drop. The present invention is used for a panel with pixels of small area and high resolution.

13 Claims, 11 Drawing Sheets

CO-GATE ELECTRODE BETWEEN PIXELS STRUCTURE

This application claims priority for Taiwan patent application no. 107201169 filed on Jan. 24, 2018, the content of which is incorporated by reference in its entirety.

BACKGROUND OF THE INVENTION

Field of the Invention

The present invention relates to a pixel structure for a panel, particularly to a co-gate electrode between pixels structure.

Description of the Related Art

With the improvement of liquid crystal display technology, liquid crystal display panels are popularly applied to consumer electronic products, such as smart phones, tablet computers, notebooks, and liquid crystal televisions. In the consumer electronic products, thin film transistor (TFT)-based liquid crystal displays are widely used. The TFT-based liquid crystal display includes a TFT array substrate, a color filter substrate, and a liquid crystal layer. Besides, the TFT array substrate has a plurality of TFTs arranged into an array and pixel electrodes corresponded thereof.

Refer to FIG. 1. The conventional pixel 10 uses a signal terminal D to receive a frequency signal and switches a thin film transistor (TFT) 14 to charge or discharge a liquid crystal capacitor C1 and a storage capacitor C2. The TFT 14 uses its gate G1 to receive a gate signal GS from an external gate driving circuit. The gate signal GS provides positive charges or negative charges for the gate G1 to turn on or turn off the TFT 14, thereby charging or discharging the liquid crystal capacitor C1 and the storage capacitor C2. The voltages of the liquid crystal capacitor C1 and the storage capacitor C2 can affect a liquid crystal voltage that represents the level of driving the liquid crystal display.

Continuing from the abovementioned paragraph, the leakage of electricity is easily caused by switching the TFT 14, so as to decrease the voltages of the liquid crystal capacitor C1 and the storage capacitor C2 and to influence optical properties of a liquid crystal. For example, the frequency of a charging or discharging activity is 60 Hz. In other words, the time of the charging or discharging activity is 1/60 second. Since the time of the charging or discharging activity is shorter, the leakage of electricity is more difficultly observed. However, when the charging or discharging activity is undertaken using a low frequency signal of 1 Hz, the leakage of electricity is easily caused due to a fact that the time of switching the TFT 14 is too long, thereby decreasing the voltages of the liquid crystal capacitor C1 and the storage capacitor C2 and influencing the optical properties of the liquid crystal display.

The conventional dual TFT structures are shown in FIG. 2. In order to avoid the leakage of electricity, each of pixels 10 and 22 is additionally installed with a TFT 20. The TFTs 20 commonly receive an identical gate signal GC to be turned on or turned off to avoid the leakage of the liquid crystal capacitors C1 and the storage capacitors C2 of the pixels 10 and 22. Nevertheless, when the pixels 20 and 22 are combined to form a large pixel with low resolution, the problem with unsuited size is not caused. The pixels 20 and 22 are not combined to form a small pixel with high resolution since each of the pixels 20 and 22 additionally has one TFT. The problem is more serious for an amorphous silicon process.

To overcome the problems with the leakage of electricity and areas of the conventional pixels, the present invention provides a co-gate electrode between pixels structure, so as to avoid the leakage of electricity and apply to pixels of small area.

SUMMARY OF THE INVENTION

A primary objective of the present invention is to provide a co-gate electrode between pixels structure, which overturns pixels such that thin film transistors (TFTs) of the pixels are symmetrical, changes the order of switching the TFTs, and shares the gate of one of the TFTs, so as to reduce the number of the added TFTs and avoid occupying the space of the pixels, thereby applying to pixels of small area and high resolution.

Another objective of the present invention is to provide a co-gate electrode between pixels structure, which uses a group of pixels to share a gate, such that anyone of the pixels has dual gates, which prevents from the leakage of liquid crystal capacitors and storage capacitors when switching TFTs and stabilize the optical properties of a liquid crystal display.

To achieve the abovementioned objectives, the present invention provides a co-gate electrode between pixels structure, which comprises a first pixel and a second pixel. The first pixel has a first control switch and a main control switch, the first switch is electrically connected to the main control switch, the main control switch selectively receives an external voltage and transmits the external voltage to the first control switch, and the first control switch selectively receives the external voltage, lest the external voltage that is transmitted to the first pixel to charge or discharge the first pixel establish a voltage drop. The second pixel has a second control switch, the second control switch is electrically connected to the main control switch, and the second pixel selectively receives the external voltage transmitted by the main control switch, lest the external voltage that is transmitted to the second pixel to charge or discharge the second pixel establish a voltage drop.

According to an embodiment of the present invention, the gate structures of the first pixel and the second pixel are symmetrical with the main control switch being a midline.

According to an embodiment of the present invention, the first pixel further comprises a first grounding element, a first storage capacitor, and a first liquid-crystal capacitor. The first storage capacitor is electrically connected to the first grounding element and the first control switch. The first liquid-crystal capacitor is electrically connected to the first grounding element, the first storage capacitor, and the first control switch, and the first control switch controls an activity of charging or discharging the first storage capacitor and the first liquid-crystal capacitor.

According to an embodiment of the present invention, the second pixel further comprises a second grounding element, a second storage capacitor, and a second liquid-crystal capacitor. The second storage capacitor is electrically connected to the second grounding element and the second control switch. The second liquid-crystal capacitor is electrically connected to the second grounding element, the second storage capacitor, and the second control switch, and the second control switch controls an activity of charging or discharging the second storage capacitor and the second liquid-crystal capacitor.

According to an embodiment of the present invention, the first control switch, the second control switch, and the main control switch are transistors.

According to an embodiment of the present invention, the gates of the first control switch, the second control switch, and the main control switch receive signals to be turned on or turned off.

According to an embodiment of the present invention, the first control switch and the main control switch of the first pixel and the second control switch of the second pixel are applied to an amorphous silicon process.

According to an embodiment of the present invention, the size of the first pixel is larger than, smaller than, or equal to the size of the second pixel.

According to an embodiment of the present invention, each of gates of the first pixel and the second pixel has a horizontal, L-like, J-like, or interdigitated shape.

According to an embodiment of the present invention, the channel length of the gate of the first pixel has a range of 1~10 μm, the channel width of the gate of the first pixel has a range of 1~300 μm, the channel length of the gate of the second pixel has a range of 1~10 μm, and the channel width of the gate of the second pixel has a range of 1~300 μm.

According to an embodiment of the present invention, the first pixel is combined with the second pixel to apply to a pixel structure with a reflection region and a transmission region independent to each other, a pixel structure with a transmission region surrounded by a reflection region, a micro-transmission pixel structure with a transmission region arranged in a gap among reflection regions, or a pixel structure with a transparent electrode larger than a reflective electrode.

Below, the embodiments are described in detail in cooperation with the drawings to make easily understood the technical contents, characteristics and accomplishments of the present invention.

DETAILED DESCRIPTION OF THE INVENTION

Nowadays, liquid crystal displays reduce their refreshing frequency to save power. As soon as the refreshing frequency is reduced, the leakage of electricity of thin film transistors (TFTs) will be a big problem. Thus, many pixel structures that prevents from the leakage of electricity are designed. In the present invention, a pixel has two gate-controlling switches, and a part of pixels use two TFTs. Applied to pixels of small area and high resolution, the present invention can overcome the problem with insufficient space.

Figure 1:
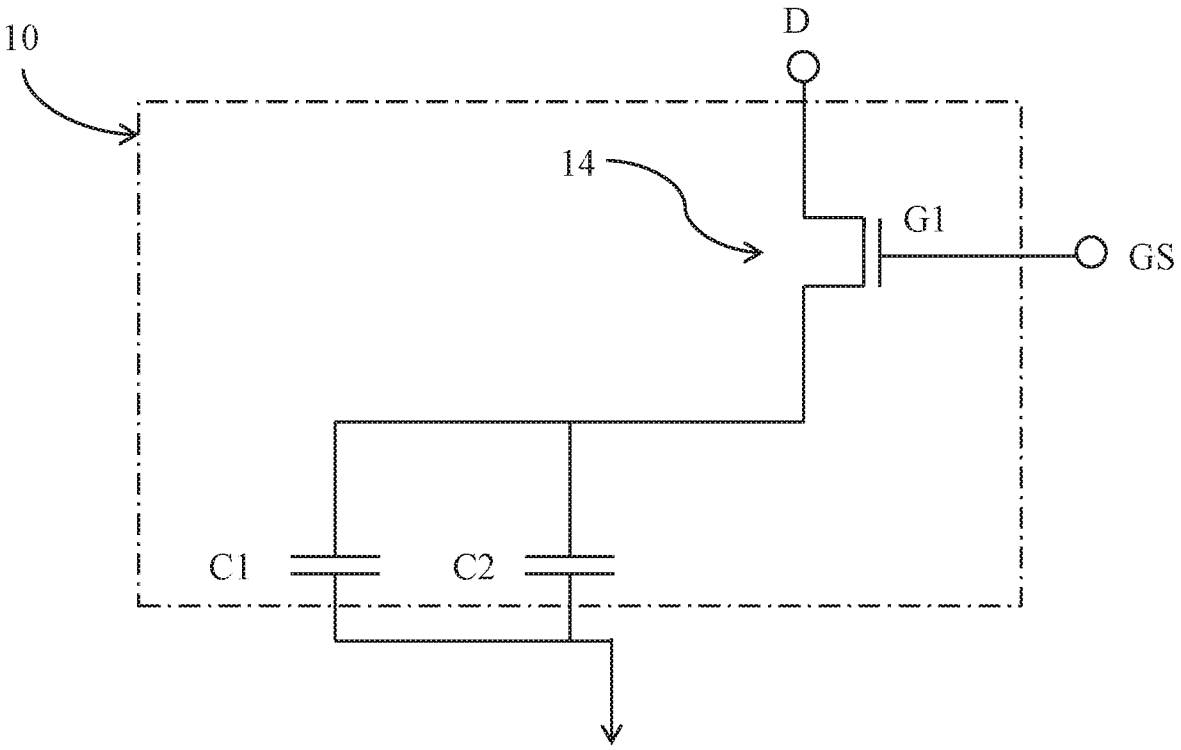
Fig. 1 (Prior Art)
FIG. 1 is a diagram showing a pixel in the conventional technology.
Figure 2:
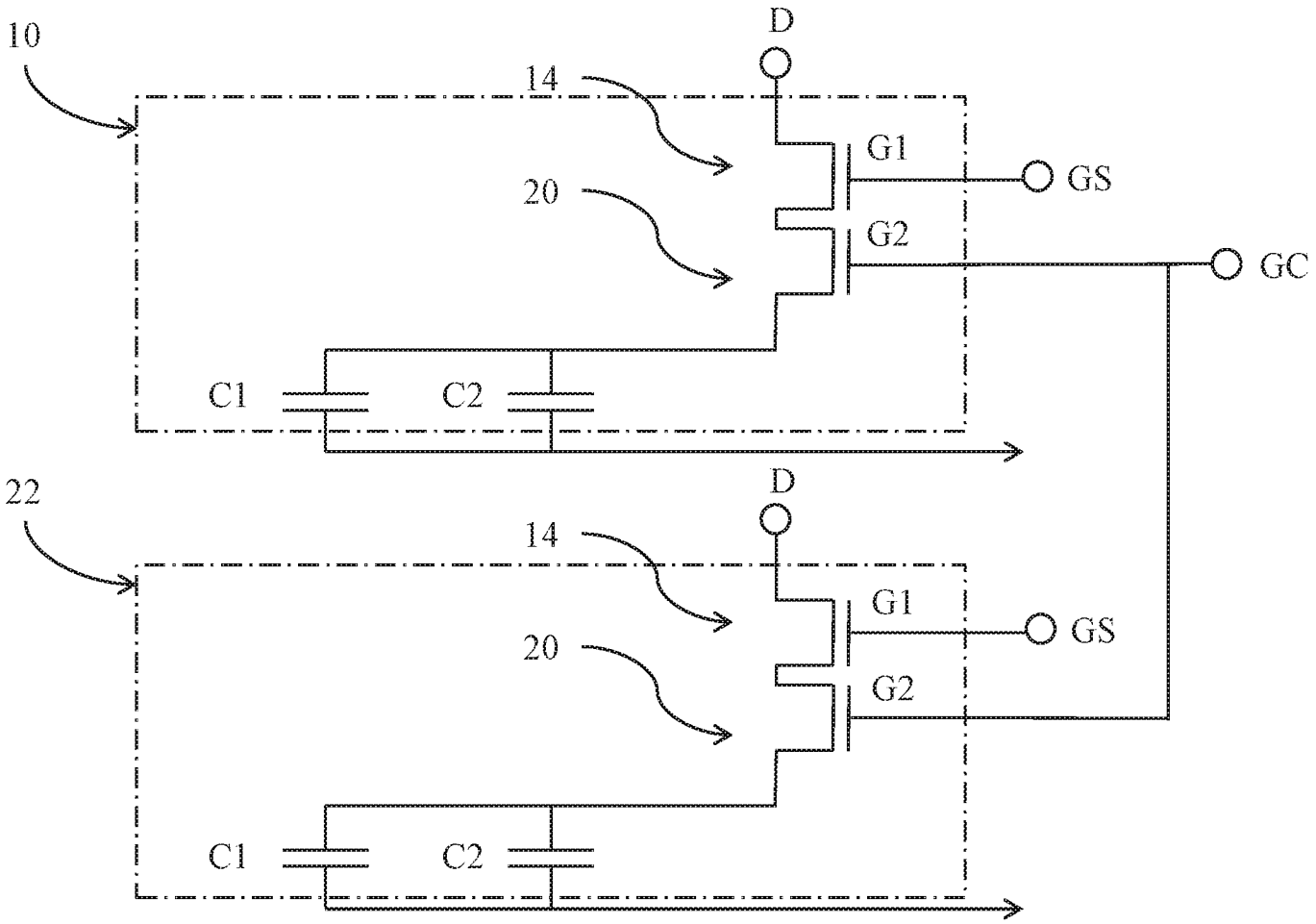
Fig. 2 (Prior Art)
FIG. 2 is a diagram showing dual pixels each having two switches in the conventional technology.
Figure 3:
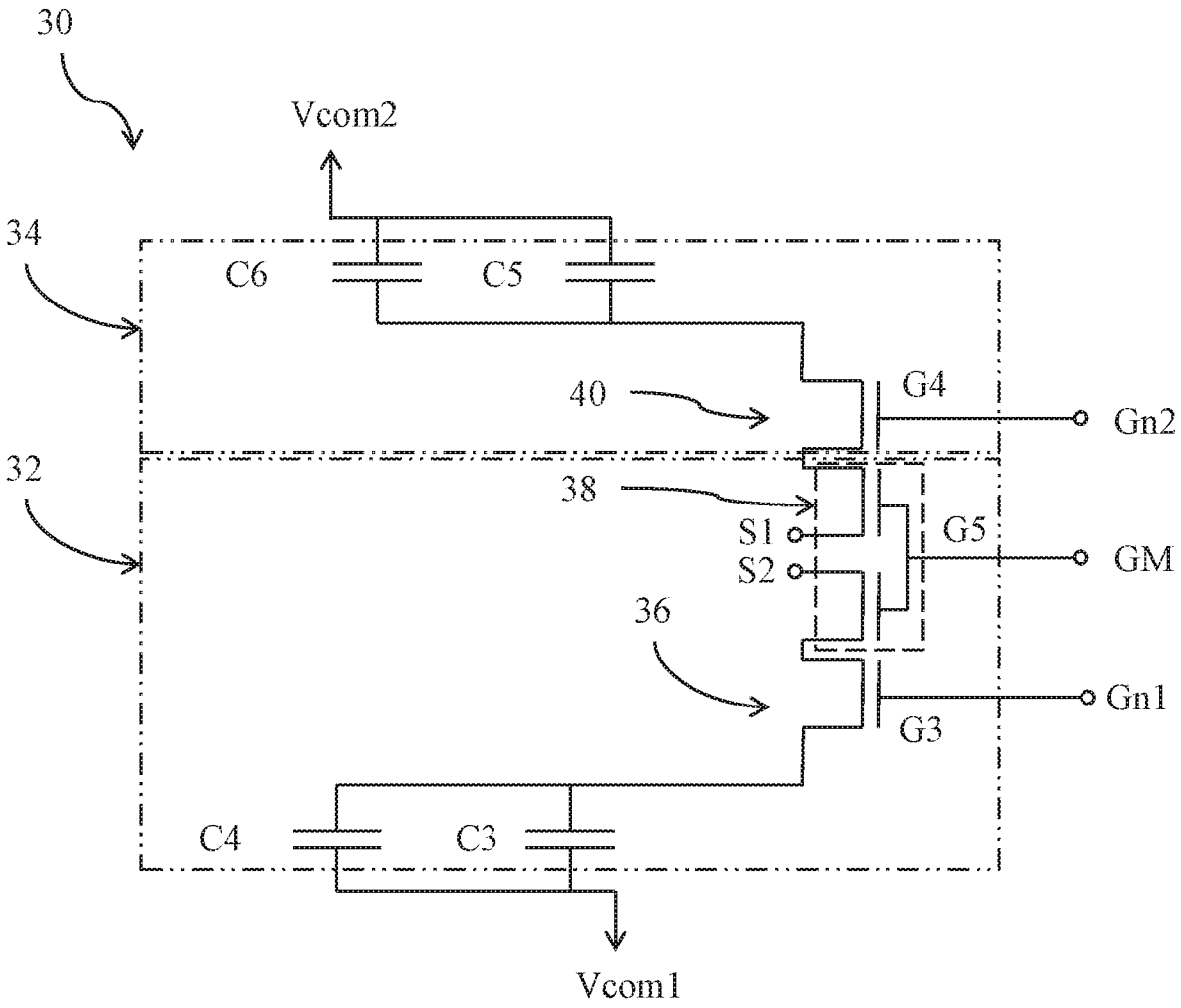
FIG. 3 is a diagram showing a co-gate electrode between pixels structure according to an embodiment of the present invention.

Refer to FIG. 3. A co-gate electrode between pixels structure 30 comprises a first pixel 32 and a second pixel 34. The first pixel 32 has a first control switch 36 and a main control switch 38. The second pixel 34 has a second control switch 40. The first control switch 36 is electrically connected to an end of the main control switch 38, and the second control switch 40 is electrically connected to another end of the main control switch 38. Thus, the first control switch 36, the main control switch 38, and the second control switch 40 are cascaded. The main control switch 38 is electrically connected to external input signal terminals. In the embodiment, the main control switch 38 is electrically connected to a first input signal terminal S1 and a second input signal terminal S2. The first control switch 36, the main control switch 38, and the second control switch 40 are transistors, such as thin film transistors (TFTs). In the embodiment, the main control switch 38 may be realized with two TFTs or a single TFT according to the design of a user, but the present invention is not limited thereto. The gate G3 of the first control switch 36 of the first pixel 32 and the gate G4 of the second control switch 40 of the second pixel 34 are symmetrical with the main gate G5 of the main control switch 38 being a midline. The main gate G5 of the main control switch 38 is electrically connected to an external main gate line GM, the gate G3 of the first control switch 36 is electrically connected to an external gate line Gn1, and the gate G4 of the second control switch 40 is electrically connected to an external gate line Gn2. The main gate line GM, the gate line Gn1, and the gate line Gn2 are electrically connected to an external gate driving circuit. The present invention should not be limited to circuits outside the pixels and connection relationship thereof.

Continuing from the abovementioned description, the first pixel 32 further comprises a first grounding element Vcom1, a first storage capacitor C3, and a first liquid crystal capacitor C4. The first storage capacitor C3 and the first liquid crystal capacitor C4 are connected in parallel and connected between the first grounding element Vcom1 and an end of the first control switch 36. The second pixel 34 further comprises a second grounding element Vcom2, a second storage capacitor C5, and a second liquid crystal capacitor C6. The second storage capacitor C5 and the second liquid crystal capacitor C6 are connected in parallel and connected between the second grounding element Vcom2 and an end of the second control switch 40.

After describing the connection relationship of the circuit of the present invention, the operation of the circuit of the present invention is introduced as follows. Refer to FIG. 3. The main control switch 38 selectively receives a frequency signal being an external voltage, such as an alternating current (AC) voltage. The main control switch 38 uses the main gate G5 to receive a main gate signal from the main gate line GM. The main gate signal may includes a positive voltage and a negative voltage, such that the main control switch 38 is turned on or turned off according to the external voltage. The external voltage is transmitted to the first control switch 36 and the second control switch 40 through the main control switch 38. The first control switch 36 selectively receives the external voltage transmitted from the main control switch 38 by switching the main control switch 38. The first control switch 36 uses the gate G3 to receive the gate signal from the gate line Gn1 to be turned on or turned off, and to charge or discharge the first storage capacitor C3 and the first liquid crystal capacitor C4. For example, when the first control switch 36 receives the gate signal to be turned on, the first control switch 36 uses the external voltage to charge the first storage capacitor C3 and the first liquid crystal capacitor C4. When the first control switch 36 is turned off without receiving the external voltage, or the capacitors are discharged, the leakage of electricity is avoided by switching the main control switch 38 when the first control switch 36 is switched. For example, when the first control switch 36 is switched, the voltage signal disappears due to time difference. In such a case, the main control switch 38 is turned off, lest the external voltage that is transmitted to the first storage capacitor C3 and the first liquid crystal capacitor C4 of the first pixel 32 to charge or discharge the first storage capacitor C3 and the first liquid crystal capacitor C4 of the first pixel 32 establish a voltage drop. The second control switch 40 selectively receives the external voltage transmitted from the main control switch 38 by switching the main control switch 38. The second control switch 40 uses the gate G4 to receive the gate signal from the gate line Gn2 to be turned on or turned off, and to charge or discharge the second storage capacitor C5 and the second liquid crystal capacitor C6. For example, when the second control switch 40 receives the gate signal to be turned on, the first control switch 36 uses the external voltage to charge the second storage capacitor C5 and the second liquid crystal capacitor C6. When the second control switch 40 is turned off without receiving the external voltage, or the capacitors are discharged, the leakage of electricity is avoided by switching the main control switch 38 when the second control switch 40 is switched. For example, when the second control switch 40 is switched, the voltage signal disappears due to time difference. In such a case, the main control switch 38 is turned off, lest the external voltage that is transmitted to the second storage capacitor C5 and the second liquid crystal capacitor C6 of the second pixel 34 to charge or discharge the second storage capacitor C5 and the second liquid crystal capacitor C6 of the second pixel 34 establish a voltage drop. The present invention does not limit whether to synchronously or non-synchronously transmit the external voltage to the first control switch 36 of the first pixel 32 and the second control switch 40 of the second pixel 34, the switching frequency and the order of each control switch, and the gate signal received. These technical features depend on the requirement of the user.

Each of the pixels of the present invention has two gate controlling switches. The main gate of the main control switch that is commonly used by two pixels is used to control the charging or discharging activity of each capacitor by switching the main control switch and the switches of the pixels. The present invention can avoid the leakage of electricity to stabilize the voltages of the capacitors of the pixels and to stably control the liquid crystal voltage even when a low frequency signal is used so that the switching time is too long. The abovementioned embodiment uses a large pixel to cooperate with a small pixel. Moreover, terms of the pixels such as "first" and "second" are merely for the purpose of distinguishability and cannot be understood as implicitly indicating the size and positions of the technical features. The present invention exemplifies the first pixel with large size and the second pixel with small size. Alternatively, the size of the first pixel is equal to or less than the size of the second pixel. The sizes of the first pixel and the second pixel are adaptable according to requirements. In addition to the first pixel and the second pixel, the present invention may use a large pixel cooperating with a small pixel, two equal pixels, or a small pixel cooperating with a large pixel. The present invention should not be limited to how to arrange pixels.

Figure 4A:
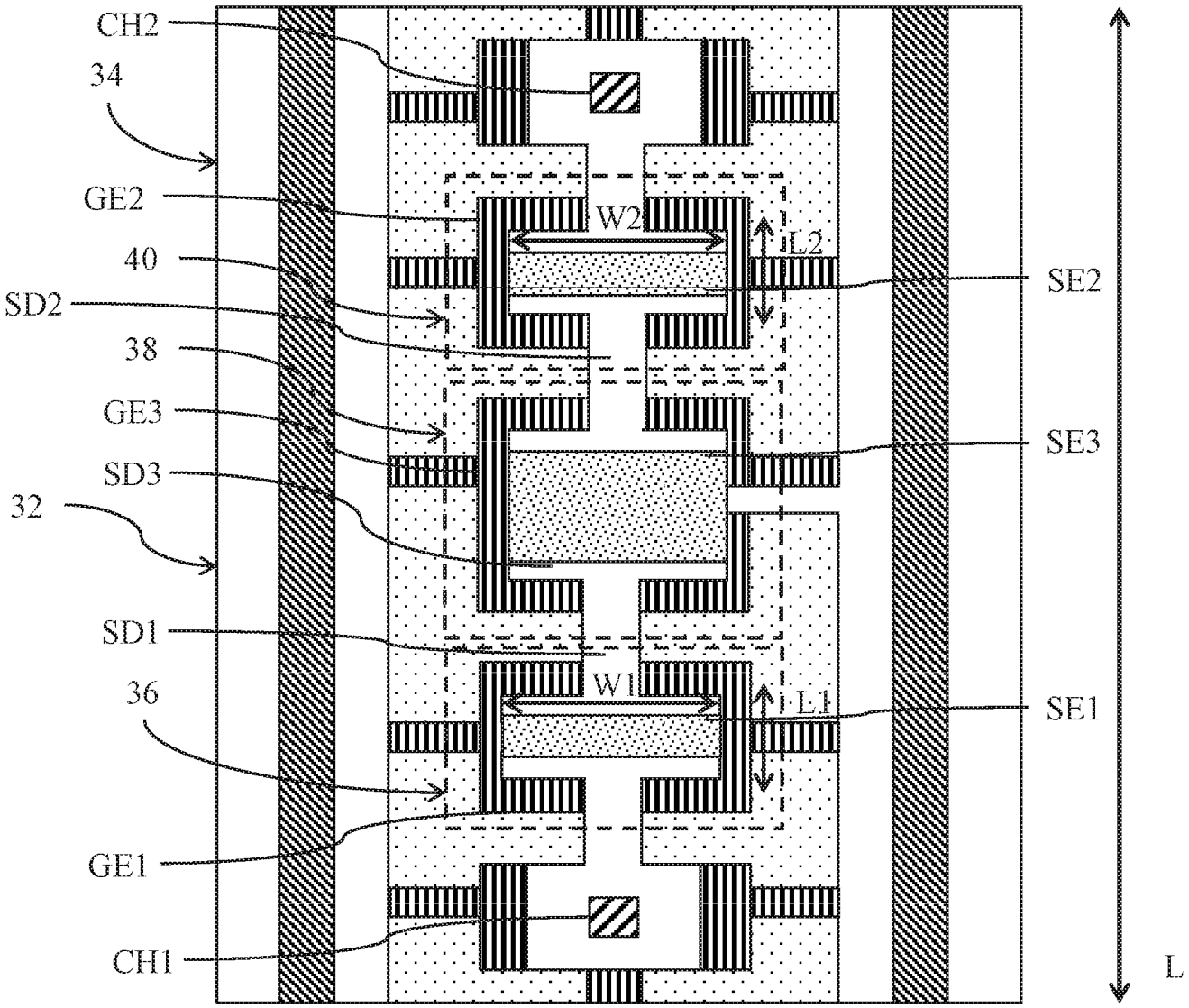
FIG. 4*a* is a diagram showing a pixels structure according to an embodiment of the present invention.
Figure 4B:
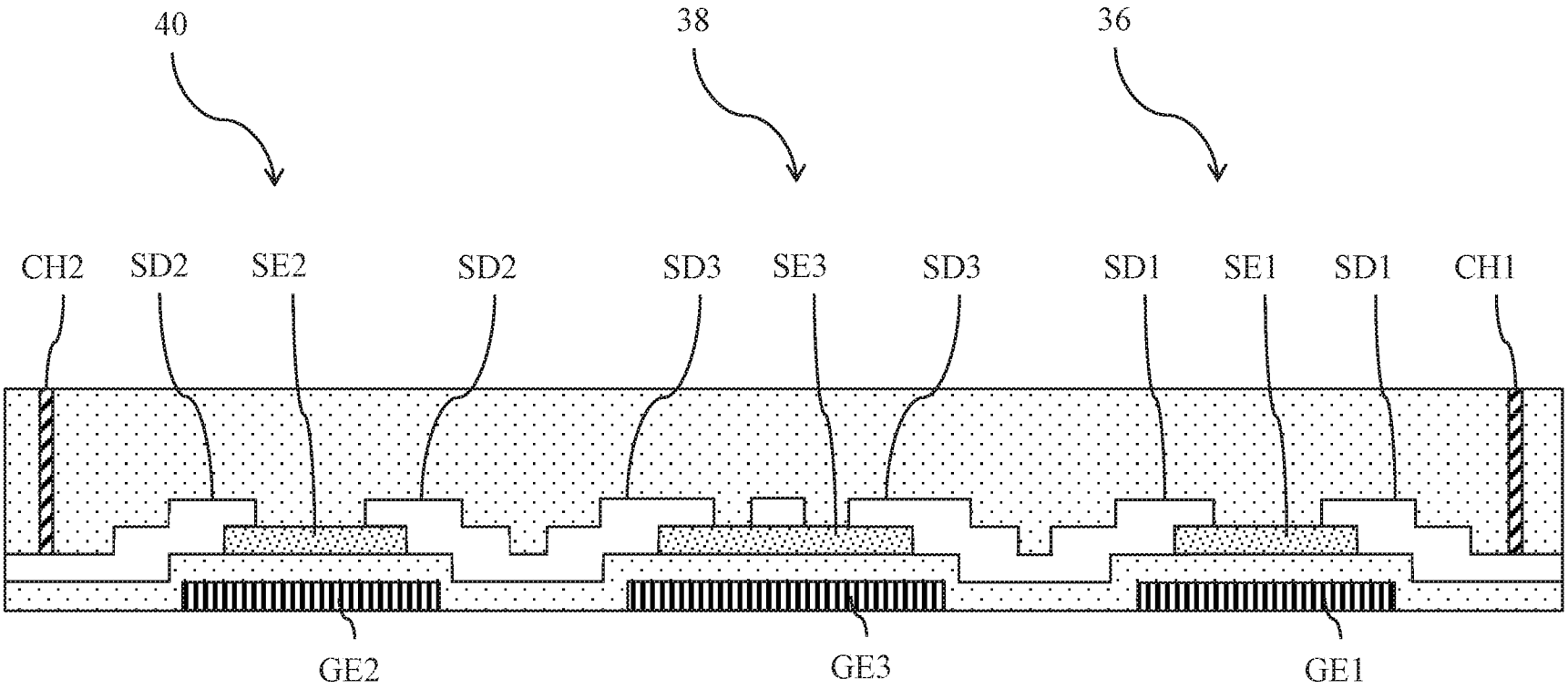
FIG. 4*b* is a cross-sectional view of FIG. 4*a;*
Figure 4C:
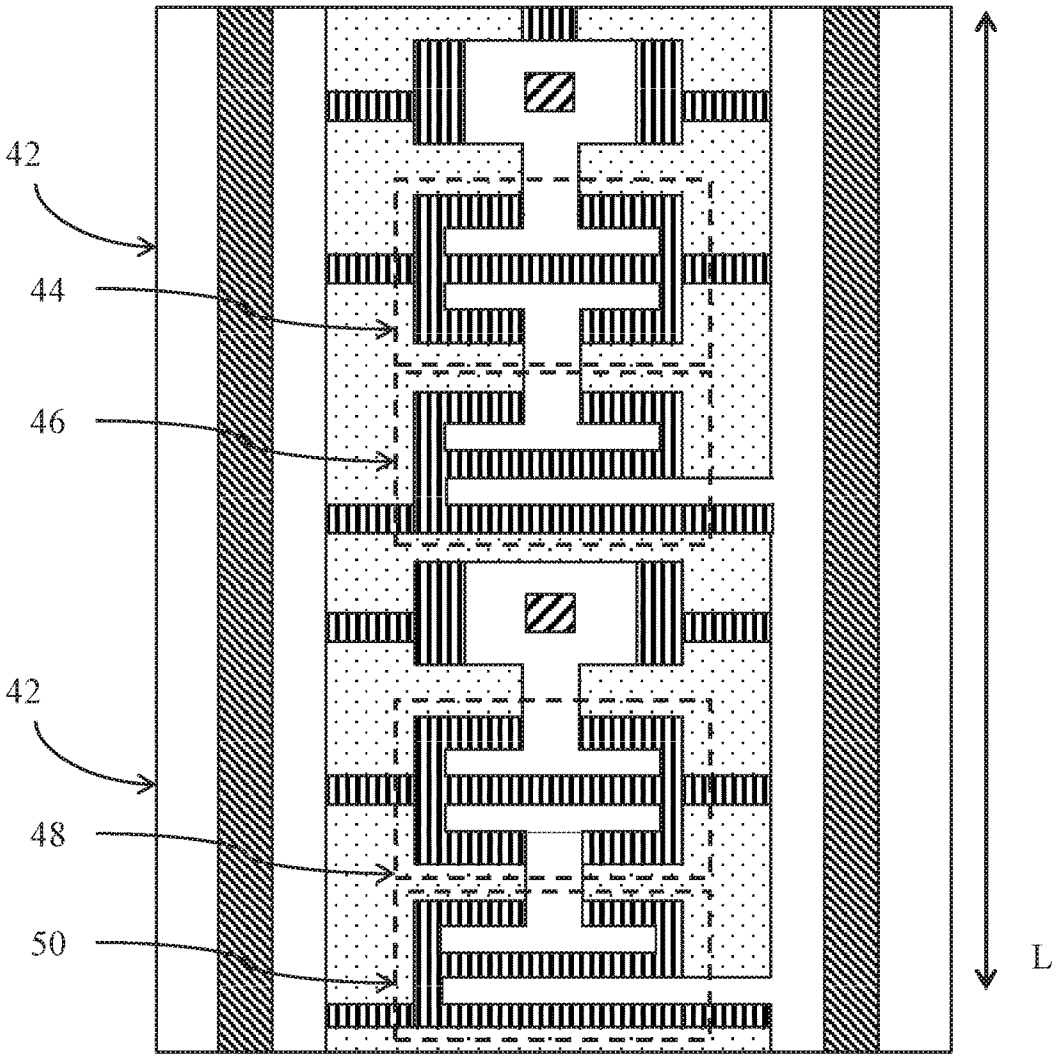
Fig. 4c (Prior Art)
FIG. 4*c* is a diagram showing a pixels structure in the conventional technology.

Refer to FIG. 4*a*, FIG. 4*b*, and FIG. 4*c*. FIG. 4*a* and FIG. 4*b* are schematic diagrams showing pixels of the present invention. Since the main gate of the main control switch is commonly used, there are only three control switches in the first pixel 32 and the second pixel 34, wherein the three control switches include the main control switch 38, the first control switch 36, and the second control switch 40. The first control switch 36 includes a gate GE1, a source or a drain SD1, and a semiconductor electrode SE1, the second control switch 40 includes a gate GE2, a source or a drain SD2, and a semiconductor electrode SE2, and the main control switch 38 includes a gate GE3, a source or a drain SD3, and a semiconductor electrode SE3. The semiconductor electrodes SE1, SE2, and SE3 are respectively arranged on the gates GE1, GE2, and GE3. The sources or the drains SD1, SD2, and SD3 are respectively arranged on the semiconductor electrodes SE1, SE2, and SE3 and respectively arranged on the gates GE1, GE2, and GE3. The first control switch 36 and the second control switch 40 uses their sources or drains SD1 and SD2 to connect to the source or the drain SD3 of the main control switch 38. The common-gate pixel structure further comprises two channel structures CH1 and CH2. The channel structure CH1 is arranged on the source or the drain SD1 of the first control switch 36. The channel structure CH2 is arranged on the source or the drain SD2 of the second control switch 40. The abovementioned structures are applied to an amorphous silicon (a-Si) process. FIG. 4*c* is a diagram showing a pixel structure in the conventional technology. As shown in FIG. 4*c*, dual pixels 42 formed by a-Si have four control switches 44, 46, 48, and 50. From FIG. 4*a*, it can be seen that the length of a structure of combining the first pixel 32 with the second pixel 34 is L. By comparing the length L with the length of the pixels 42, the pixel structure of the present invention is apparently less than the pixel structure in FIG. 4*c*. Compared with the conventional pixel, the present invention is easily applied to the pixel structure of high resolution and small area. In addition, the present invention has a design that prevents from the leakage of electricity for the control switch with dual gates.

Refer to FIG. 4*a*. Each of the gates of the first pixel 32 and the second pixel 34 has a horizontal shape, but the present invention is not limited thereto. The user can design the shape of the gate of the pixel according to requirements. For example, each of the gates of the first pixel 32 and the second pixel 34 has an L-like, J-like, or interdigitated shape. The present invention mainly claims the channel length of the gate of the first pixel 32 and the channel length of the gate of the second pixel 34. The channel length of the gate of the first pixel 32 has a range of 1~10 μm, and the channel width of the gate of the first pixel 32 has a range of 1~300 μm. The channel length of the gate of the second pixel 34 has a range of 1~10 μm, and the channel width of the gate of the second pixel 34 has a range of 1~300 μm. The aspect ratio of each of the first pixel 32 and the second pixel 34 equals to 0.2~300. As long as the channel length and the channel width of the gate satisfy the abovementioned limitation, any shape of the gate is included within the scope of the present invention.

Figure 5A:
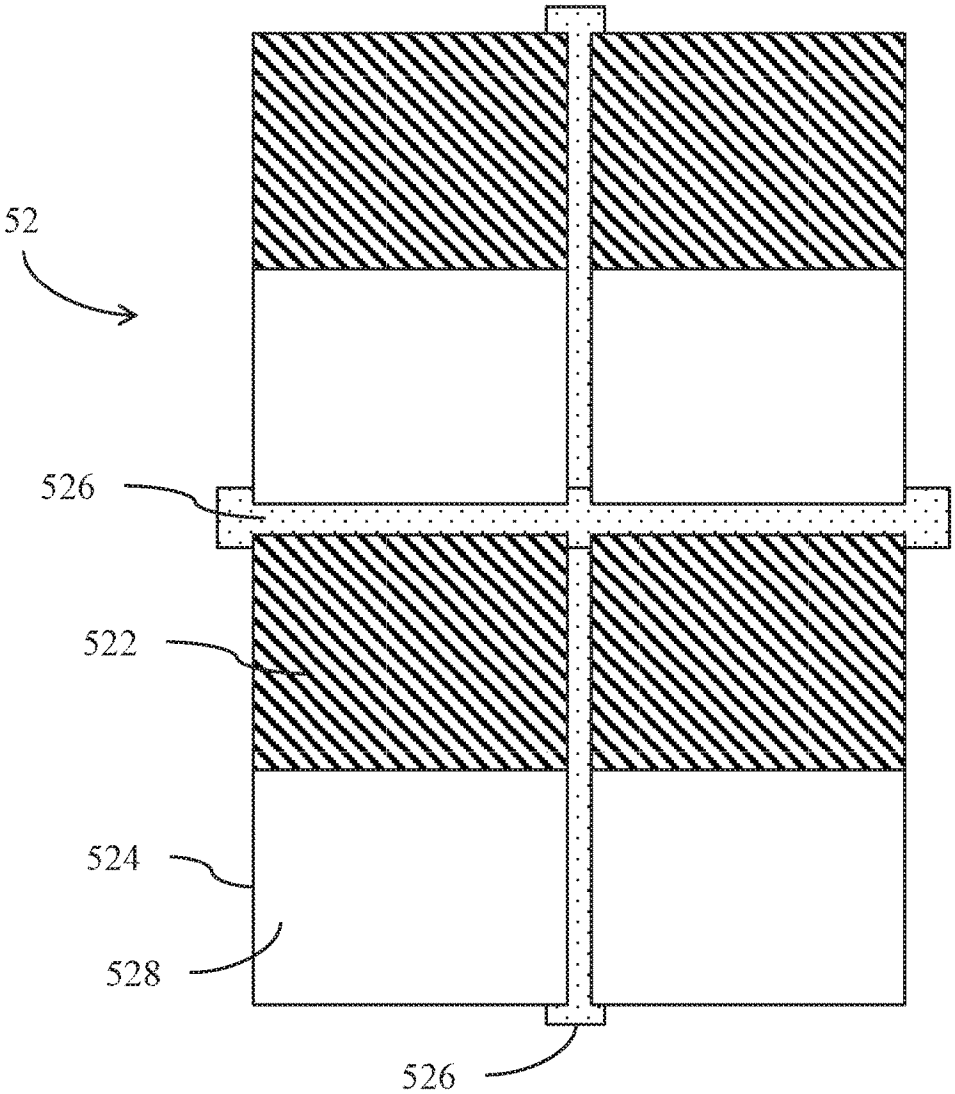
FIGS. 5*a*-5*d* are diagrams showing a co-gate electrode between pixels structure applied to various pixel structures according to an embodiment of the present invention.
Figure 5B:
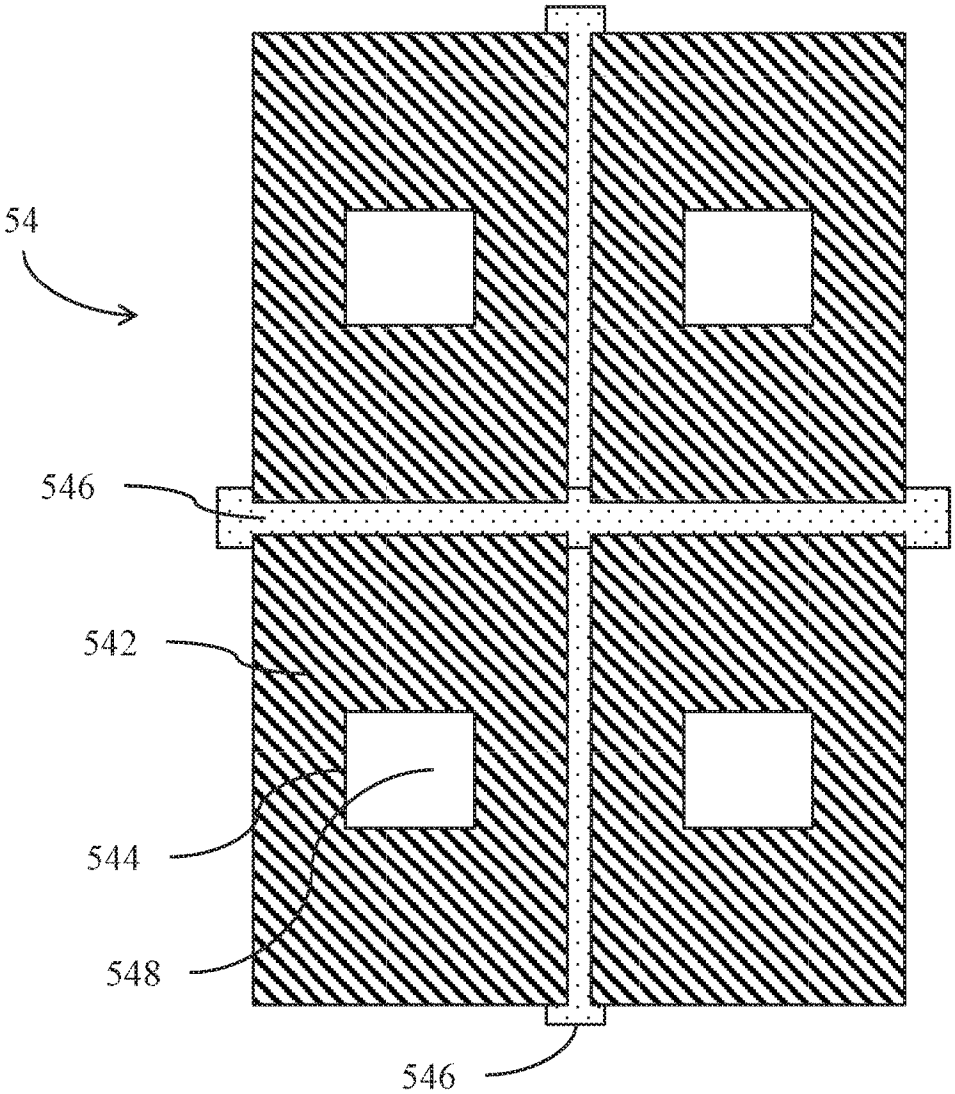
Figure 5C:
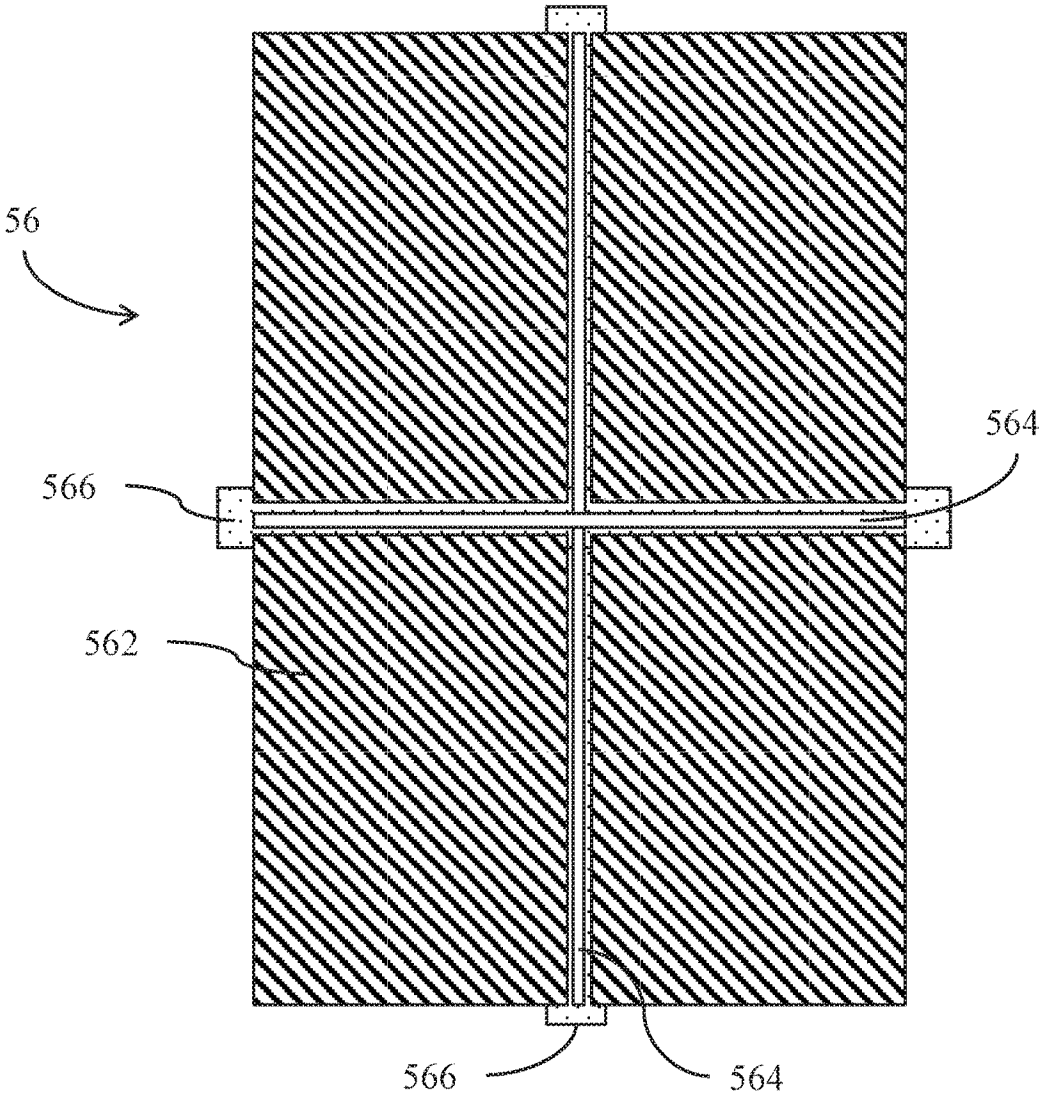
Figure 5D:
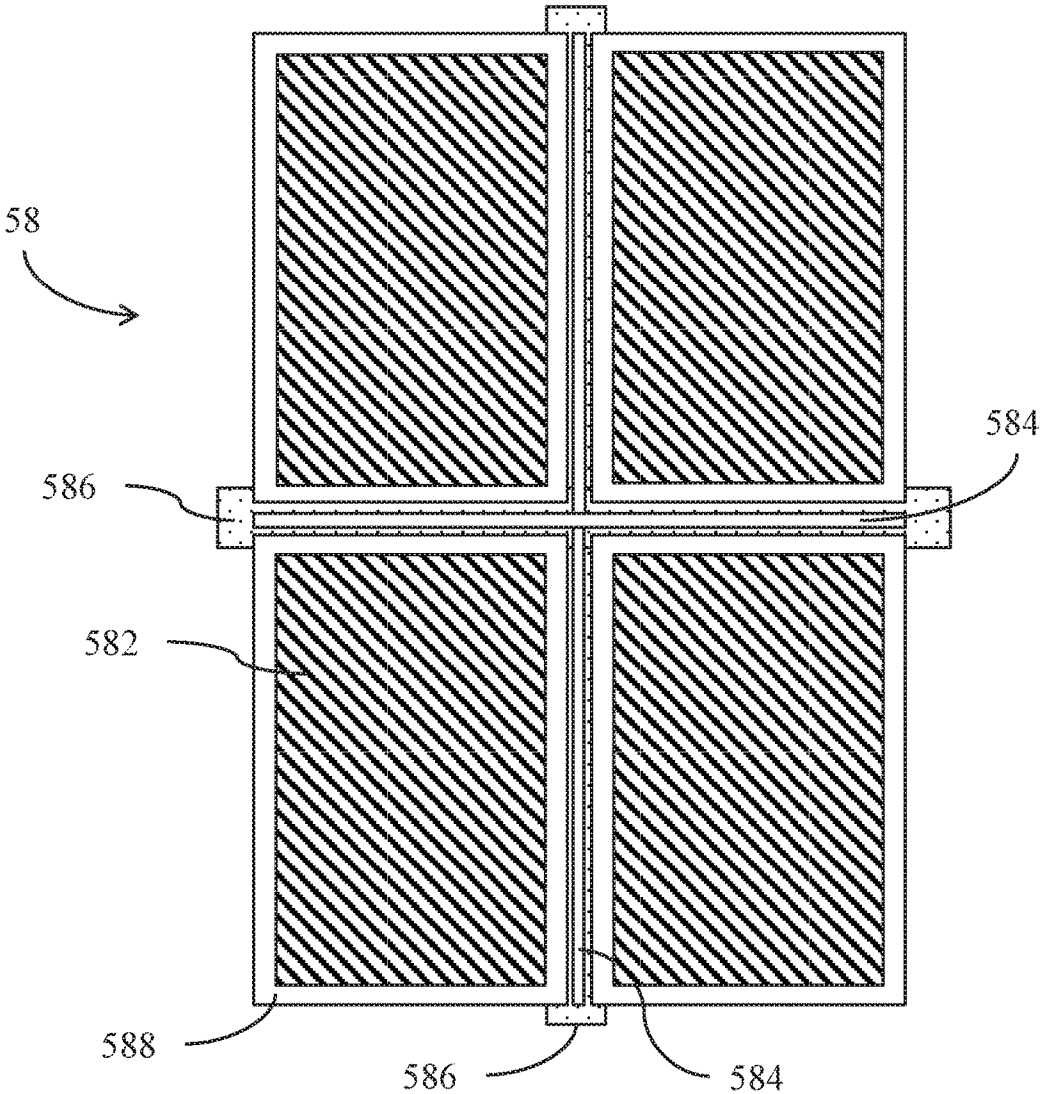

Refer to FIGS. 5*a*-5*d*. The common-gate pixel structure of the present invention is also applied to the following pixel structures. As shown in FIG. 5*a*, the common-gate pixel structure is applied to a pixel structure 52 with a reflection region and a transmission region independent to each other, wherein the pixel structure has a reflection region 522, a transmission region 524, a signal line 526, and a transparent electrode 528. As shown in FIG. 5*b*, the common-gate pixel structure is applied to a pixel structure 54 with a transmission region surrounded by a reflection region, wherein the pixel structure 54 has a reflection region 542, a transmission region 544, a signal line 546, and a transparent electrode 548. As shown in FIG. 5*c*, the common-gate pixel structure is applied to a micro-transmission pixel structure 56 with a transmission region arranged in a gap among reflection regions, wherein the micro-transmission pixel structure 56 has a reflection region 562, a transmission region 564, and a signal line 566. As shown in FIG. 5*d*, the common-gate pixel structure is applied to a pixel structure 58 with a transparent electrode larger than a reflective electrode, wherein the pixel structure 58 has a reflection region 582, a transmission region 584, a signal line 586, and a transparent electrode 588.

Figure 6:
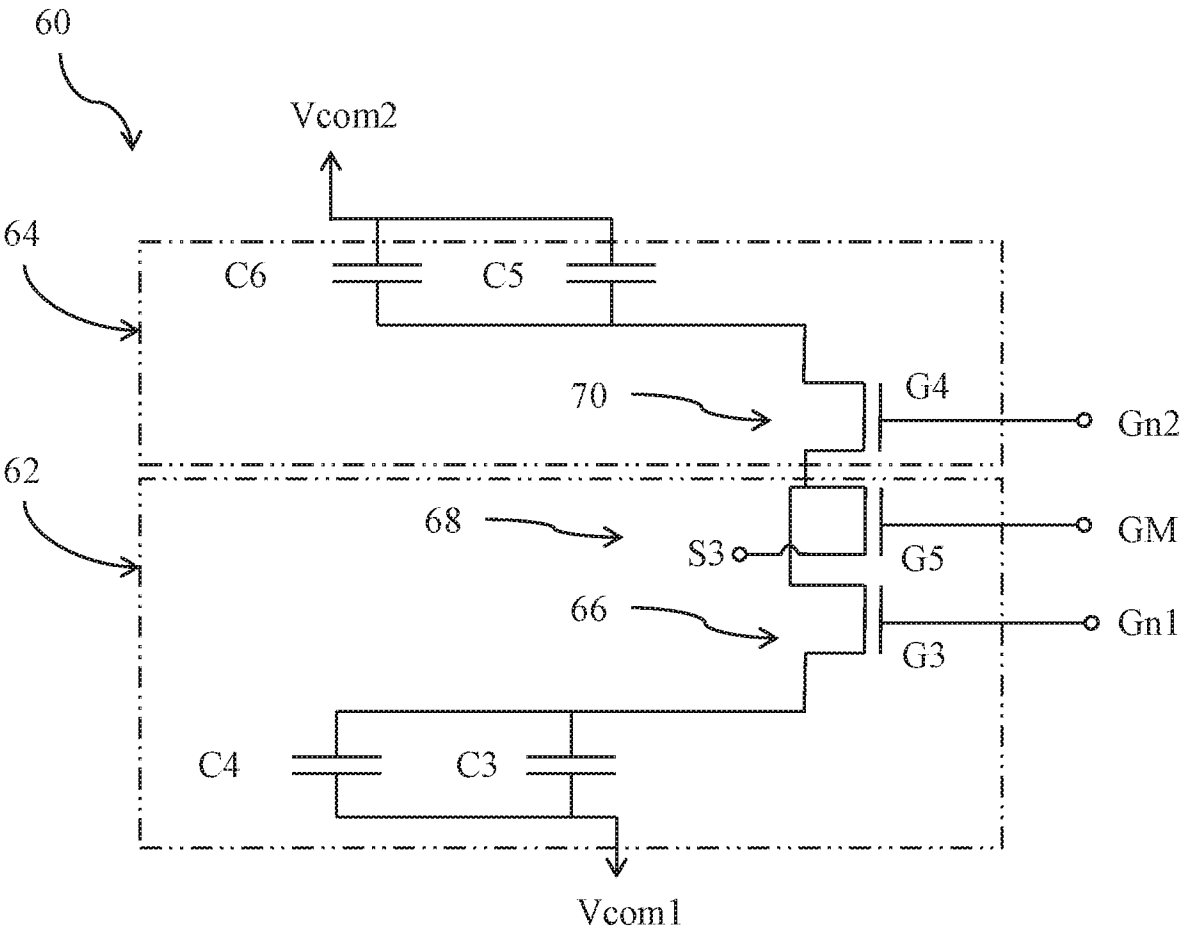
FIG. 6 is a diagram showing a co-gate electrode between pixels structure according to another embodiment of the present invention.

In addition to the abovementioned embodiment, the present invention provides another embodiment of a co-gate electrode between pixels structure. Refer to FIG. 6. The main control switch is a single thin film transistor. The common-gate pixel structure 60 includes a first pixel 62 and a second pixel 64. The first pixel 62 has a first control switch 66 and a main control switch 68. The second pixel 64 has a second control switch 70. The first control switch 66 is electrically connected to an end of the main control switch 68, and the end of the main control switch 68 is electrically connected to the second control switch 70. The main control switch 68 is electrically connected to an external input signal terminal. In the embodiment, another end of the main control switch 68 is electrically connected to a third input signal terminal S3. Moreover, terms of the pixels such as "first", "second", and "third" are merely for the purpose of described order and cannot be understood as implicitly indicating the connecting order. The first control switch 66, the main control switch 68, and the second control switch 70 are transistors, such as thin film transistors. The symmetrical structures and the operation thereof are the same to those of the abovementioned embodiment so will not be reiterated.

No matter any shape of the gate or the applied pixel structure, the present invention mainly provides a co-gate electrode between pixels structure, which uses a control switch shared by two pixels, lest the leakage of electricity of capacitors occur, thereby stabilizing the voltage and optical properties of liquid crystal and saving the size of the pixels. The present invention is very suited for a structure with small pixels and high resolution and widely applied in many fields. In the field of a liquid crystal display, the present invention has very high competitiveness.

The embodiments described above are only to exemplify the present invention but not to limit the scope of the present invention. Therefore, any equivalent modification or variation according to the shapes, structures, features, or spirit disclosed by the present invention is to be also included within the scope of the present invention.

What is claimed is:

1. A co-gate electrode between pixels structure comprising:

a first pixel having a first control switch and a main control switch, the first control switch is electrically connected to the main control switch, the main control switch selectively receives an external voltage and transmits the external voltage to the first control switch, and the first control switch selectively receives the external voltage, lest the external voltage that is transmitted to the first pixel to charge or discharge the first pixel establish a voltage drop; and a second pixel having a second control switch, the second control switch is electrically connected to the main control switch, the second pixel selectively receives the external voltage transmitted by the main control switch, lest the external voltage that is transmitted to the second pixel to charge or discharge the second pixel establish a voltage drop, the main control switch is connected between the first control switch and the second control switch, gate structures of the first pixel and the second pixel are symmetrical with a main gate of the main control switch being a midline, the main gate is arranged between the gate structures of the first pixel and the second pixel, and the main control switch is connected to the first control switch and the second control switch in series.

2. The co-gate electrode between pixels structure according to claim 1, wherein the first pixel further comprises:

a first grounding element;

a first storage capacitor electrically connected to the first grounding element and the first control switch; and a first liquid-crystal capacitor electrically connected to the first grounding element, the first storage capacitor, and the first control switch, and the first control switch controls an activity of charging or discharging the first storage capacitor and the first liquid-crystal capacitor.

3. The co-gate electrode between pixels structure according to claim 1, wherein the second pixel further comprises:

a second grounding element;

a second storage capacitor electrically connected to the second grounding element and the second control switch; and a second liquid-crystal capacitor electrically connected to the second grounding element, the second storage capacitor, and the second control switch, and the second control switch controls an activity of charging or discharging the second storage capacitor and the second liquid-crystal capacitor.

4. The co-gate electrode between pixels structure according to claim 1, wherein the first control switch, the second control switch, and the main control switch are transistors.

5. The co-gate electrode between pixels structure according to claim 4, wherein gates of the first control switch, the second control switch, and the main control switch receive signals to be turned on or turned off.

6. The co-gate electrode between pixels structure according to claim 1, wherein the first control switch and the main control switch of the first pixel and the second control switch of the second pixel are applied to an amorphous silicon process.

7. The co-gate electrode between pixels structure according to claim 1, wherein a size of the first pixel is larger than, smaller than, or equal to a size of the second pixel.

8. The co-gate electrode between pixels structure according to claim 1, wherein each of gates of the first pixel and the second pixel has a horizontal, L-like, J-like, or interdigitated shape.

9. The co-gate electrode between pixels structure according to claim 1, wherein a channel length of a gate of the first pixel has a range of 1~10 μm, and a channel width of a gate of the first pixel has a range of 1~300 μm.

10. The co-gate electrode between pixels structure according to claim 1, wherein a channel length of a gate of the second pixel has a range of 1~10 μm, and a channel width of a gate of the second pixel has a range of 1~300 μm.

11. The co-gate electrode between pixels structure according to claim 1, wherein the first pixel is combined with the second pixel to apply to a pixel structure with a reflection region and a transmission region that are independent to each other, a pixel structure with a transmission region surrounded by a reflection region, a micro-transmission pixel structure with a transmission region arranged in a gap among reflection regions, or a pixel structure with a transparent electrode larger than a reflective electrode.

12. The co-gate electrode between pixels structure according to claim 1, wherein each of the first control switch, the second control switch, and the main control switch further comprises a gate, at least one source or at least one drain, and a semiconductor electrode, the semiconductor electrode is arranged on the gate, the at least one source or the at least one drain is arranged on the semiconductor electrode and the gate, the at least one source or the at least one drain of the first control switch is electrically connected to the at least one source or the at least one drain of the main control switch, and the at least one source or the at least one drain of the second control switch is electrically connected to the at least one source or the at least one drain of the main control switch.

13. The co-gate electrode between pixels structure according to claim 12, further comprising a channel structure arranged on the at least one source or the at least one drain.

* * * * *